US005425650A

United States Patent [19]

Maeda

[11] Patent Number: 5,425,650

[45] Date of Patent: Jun. 20, 1995

[54] INCLINED ENGAGEMENT PREVENTION STRUCTURE FOR CONNECTOR

[75] Inventor: Akira Maeda, Shizuoka, Japan

[73] Assignee: Yazaki Corporation, Japan

[21] Appl. No.: 186,632

[22] Filed: Jan. 26, 1994

[30] Foreign Application Priority Data

Feb. 1, 1993 [JP] Japan ..... 5-014720

[51] Int. Cl.[6] ..... H01R 13/629

[52] U.S. Cl. ..... 439/374; 439/680

[58] Field of Search ..... 439/177, 335, 374, 680, 439/681

[56] References Cited

U.S. PATENT DOCUMENTS 5,282,757 1/1994 Maeda ..... 439/374

FOREIGN PATENT DOCUMENTS 60-42282 3/1985 Japan .

*Primary Examiner*—Eugene F. Desmond

*Attorney, Agent, or Firm*—Wigman, Cohen, Leitner & Myers

[57] ABSTRACT

In an inclined engagement prevention structure for a connector having: a female connector housing (9) formed with at least one guide projection (6) extending inward therein and provided with a plurality of male terminals (13), and a male connector housing (11) formed with at least one guide groove (8) on an outer surface thereof so as to be engaged with the guide projection (6) and provided with a plurality of female terminals, in particular the guide projection (6) is formed with an incline prevention projection (10) at an inward end thereof, and the guide groove (8) is formed with a slide guide groove (12) at an inner end thereof in such a way that the incline prevention projection (10) can be engaged with and slidable along the slide guide groove (12).

5 Claims, 3 Drawing Sheets

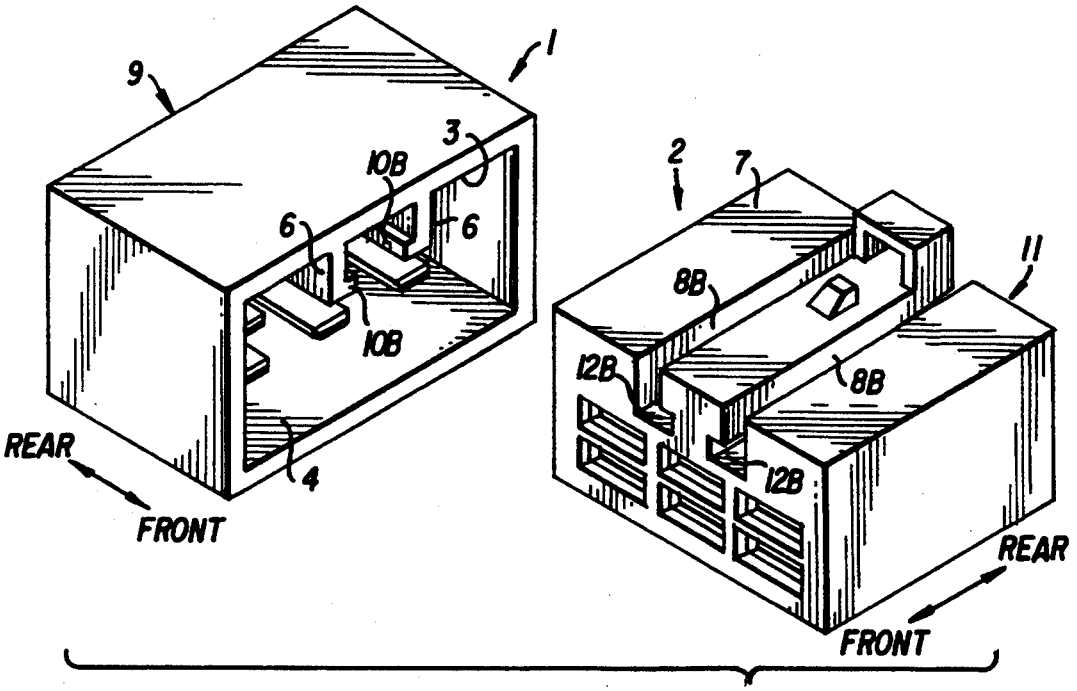
FIG. 1B
FIG. 1C
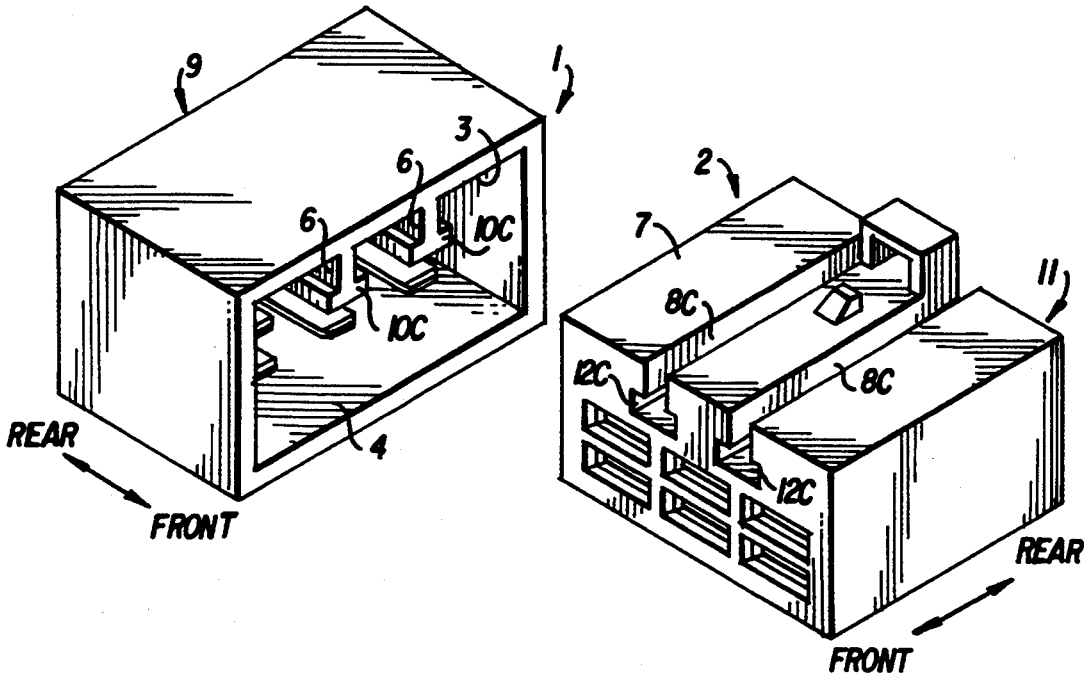

INCLINED ENGAGEMENT PREVENTION STRUCTURE FOR CONNECTOR

BACKGROUND OF THE INVENTION

1. Field of the Invention

The present invention relates to an inclined engagement prevention structure for a connector, and more specifically to a structure of a connector by which it is possible to prevent two male and female connectors from being engaged with each other under an inclined condition, without interference of male terminals arranged within a female connector housing with a male connector housing.

2. Description of the Related Art

An example of prior art connectors is disclosed in Japanese Published Unexamined (Kokai) Utility Model Application No. 60-42282, for instance. In this connector, the connector is composed of a female connector and a male connector. The female connector includes a female connector housing formed with a fitting chamber in which a plurality of male tab terminals are arranged. The male connector includes a male connector housing in which a plurality of female terminals mated with the male terminals of the female connector are arranged. In more detail, in the female connector housing, a pair of inner guide projections are formed within the female connector housing so as to extend in the connector mating direction. Further, an engage hole is formed in the female connector housing. On the other hand, in the male connector housing, an outer guide groove is formed on the outer surface of the male connector housing so as to be mated with the inner guide projections of the female connector housing. Further, an outer lock arm is formed in the outer guide groove, and an engage projection is formed on this outer lock arm. Therefore, when the male and female connector housings are both mated with each other, the two inner guide projections of the female connector housing are engaged with the outer guide groove of the male connector housing in such a way that the outer lock arm is guided along between the two inner guide projections until an engage projection of the lock arm of the male connector housing is engaged with an engage hole formed in the female connector housing.

In the above-mentioned connector as described above, however, when the male connector housing is mated with the female connector housing under an inclined condition, since the ends of the male terminals arranged within the female connector housing are interfered with the end surface of the male connector housing, there exists a problem in that the male terminals of the female connector are deformed. The above-mentioned problem may be overcome by increasing the length of the female connector housing in the mating direction. In this case, however, another problem may arise in that the size of the female connector housing is inevitably increased.

SUMMARY OF THE INVENTION

With these problems in mind, therefore, it is the primary object of the present invention to provide an inclined engagement prevention structure for a connector, by which the two connector housings will not be engaged under an inclined condition so as to prevent one of the connector housing interfering with terminals of the other connector housing, and further which does not increase the size of the connector.

To achieve the above-mentioned object, the present invention provides an inclined engagement prevention structure for a connector having: a female connector housing formed with at least one guide projection extending inward therein and provided with a plurality of male terminals; and a male connector housing formed with at least one guide groove on an outer surface thereof so as to be engaged with the guide projection and provided with a plurality of female terminals, wherein the guide projection is formed with an incline prevention projection at an inward end thereof, and the guide groove is formed with a slide guide groove at an inner end thereof in such a way that the incline prevention projection can be engaged with and slidable along the slide guide groove.

In the above-mentioned inclined engagement prevention structure for a connector, the incline prevention projection of the guide projection extends outward or inward or both outward and inward from the guide projection and the slide guide groove of the guide groove extends also outward or inward or both inward and outward from the guide groove. Further, the incline prevention projection of the guide projection is formed at least near an opening end of the female connector housing.

BRIEF DESCRIPTION OF THE DRAWINGS

FIG. 1A, 1B, and 1C are perspective views of illustrative embodiments of the inclined engagement prevention structure for a connector according to the present invention;

DETAILED DESCRIPTION OF THE PREFERRED EMBODIMENTS

One embodiment of the inclined engagement prevention structure for a connector will be described hereinbelow with reference to the attached drawings.

Figure 1A:
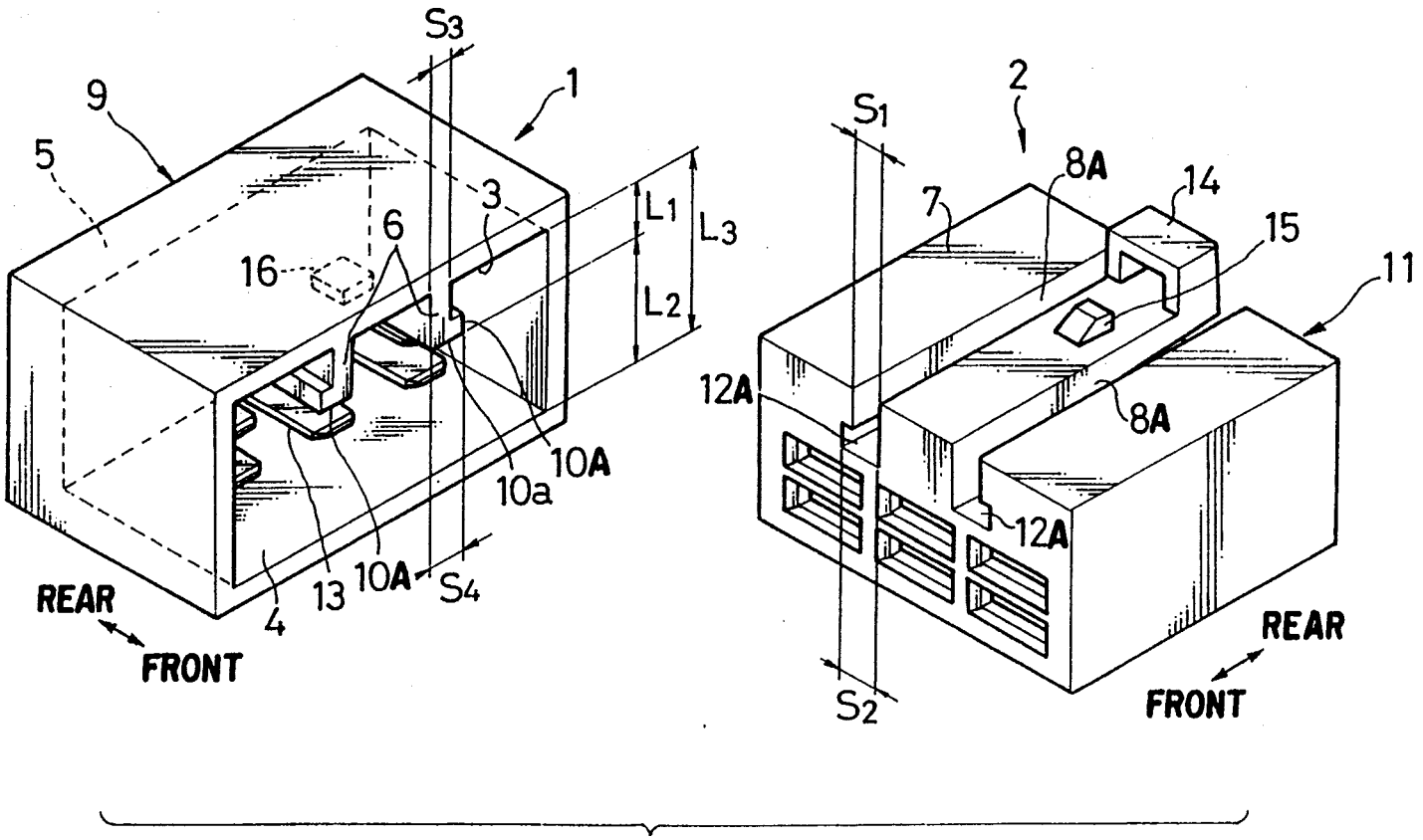

In FIGS. 1A, 1B, and 1C, a connector to which the structure of the present invention is applied is composed of a female connector 1 and a male connector 2. The female connector 1 comprises a female connector housing 9 and the male connector 2 comprises a male connector housing 11. In the same way as with the case of the conventional connector, the female connector housing 9 is formed with a pair of parallel-arranged guide projections 6 on an inner wall 3 of the housing 9 so as to extend from an open (rear) side 4 of an engagement chamber of housing 9 to a bottom wall (front) side 5 of the housing 9. Further, the male connector housing 11 is formed with a pair of parallel-arranged guide grooves 8A (grooves 8B, FIG. 1B, or grooves 8C, FIG. 1C) engageable with the guide projections 6 on an outer wall 7 of the housing 11 so as to extend from a front side to a rear side of the housing 11.

Further, in the same way as with the case of the conventional connector, a plurality of male tab terminals 13 are arranged within the female connector housing 9, and a plurality of female terminals (not shown) mated with the male tab terminals are arranged within the male connector housing 11. Further, the female connector housing 9 is formed with an engagement hole 16 on the upper wall of the housing 9 and between the two guide projections 6. Further, the male connector housing 11 is formed with a flexible lock arm 14 between the two slide guide grooves 12A (FIG. 1A), 12B (FIG. 1B), or 12C (FIG. 1C). Further engagement projection 15 is formed on the lock arm 14 so as to be engageable with tile engagement hole 16 of the female connector housing 9.

Being different from the conventional connector, in the male and female connector housings 9 and 11 of the connector according to the present invention, each of the guide projections 6 of the female connector housing 9 is formed with an incline prevention projection 10 integral with the end of the guide projection 6, and further each of the grooves 8A (grooves 8B, FIG. 1B, or grooves 8C, FIG. 1C) is formed with a slide guide grooves 12A (FIG. 1A), 12B (FIG. 1B), or 12C (FIG. 1C) engageable with the incline prevention projection 10A (projection 10B, FIG. 1B, or projection 10C, FIG. 1C) in connection with the bottom of the guide grooves 8A (grooves 8B, FIG. 1B, or grooves 8C, FIG. 1C), respectively. The incline prevention projection extends outward 10A (FIG. 1A), inward 10B (FIG. 1B), or both inward and outward (FIG. 1C) from the inner end of the guide projection 6 perpendicular thereto into an L-shape (FIGS. 1A and 1B), or T-shape (FIG. 1C), and the mating guide groove 12A (FIG. 1A), 12B (FIG. 1B), or 12C (FIG. 1C) also extends outward from the bottom end of the guide groove 8A (FIG. 1A), groove 8B (FIG. 1B), or groove 8C (FIG. 1C).

The width S3 of the vertical portion of the guide projection 6 is determined to be narrower than that S1 of the guide groove 8A (FIG. 1A), groove 8B (FIG. 1B), or groove 8C (FIG. 1C). The width S4 of the horizontal portion of the incline prevention projection 10A (projection 10B, FIG. 1B, or projection 10C, FIG. 1C) of the guide projection 6 is determined to be wider than that S1 of the guide groove 9 but to be narrower than that S2 of the slide guide groove 12A (FIG. 1A), 12B (FIG. 1B), or 12C (FIG. 1C) of the guide groove 8A (FIG. 1A), groove 8B (FIG. 1B), or groove 8C (FIG. 1C). Further, it is preferable to determine a long distance L1 from the inner wall surface 3 of the female connector housing 9 to an inward end **10*a* of the incline prevention projection 10A (projection 10B, FIG. 1B, or projection 10C, FIG. 1C), form the standpoint of prevention of interference between the male tab terminals 13 of the female connector housing 9 and the male connector housing 2**, as described later.

Figure 2:
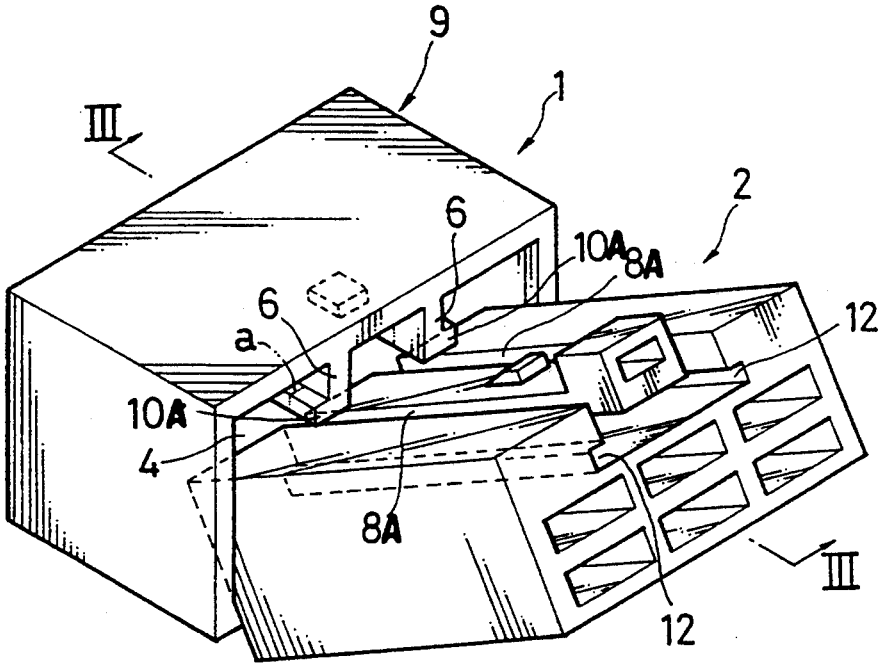
FIG. 2 is a perspective view for assistance in explaining an engagement of the male and female connector housings of the structure according to the present invention.

Further, in variations of this embodiment, it is also possible to form the incline prevention projection 10B of the guide projection 6 so as to extend inward (FIG. 1B) or both outward and inward (10C of FIG. 1C). Further, it is also possible to form the slide guide groove 12B (FIG. 1B) or 12C (FIG. 1C) of the guide groove 8B or 8C (FIG. 1C) so as to extend inward (FIG. 1B) or both outward and inward (FIG. 1C) in the same way as with the case of the incline prevention projection 10A, 10B, or 10C, respectively. Further, as shown by a dashed line a in FIG. 2, it is possible to form the incline prevention projection 10A, 10B, or 10C, respectively, so as to extend shortly and only near the open side 4 of the female connector housing 9.

In the connector according to the present invention as described above, when the male connector housing 11 is engaged with the female connector housing 9 under the parallel arrangement condition with respect to each other, since the guide projections 6 formed with the incline prevention projections 10A, 10B, or 10C, respectively are engaged with the guide grooves 8A as seen in FIG. 1A (grooves 8B, FIG. 1B, or grooves 8C, FIG. 1C) formed with the slide grooves 12A (FIG. 1A), 12B (FIG. 1B), or 12C (FIG. 1C), respectively, it is possible to smoothly engage the male connector housing 11 with the female connector housing 9 until the engage projection 15 of the lock arm 14 can be engaged with the engage hole 16 of the female connector housing 9.

Figure 3:
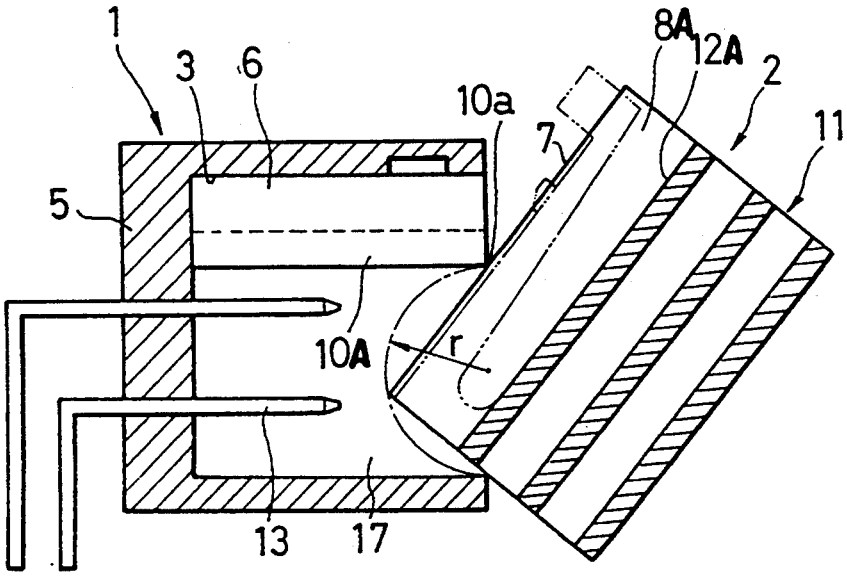
FIG. 3 is a cross-sectional view taken along the line III—III shown in FIG. 2.

Further, when the male connector housing 11 is engaged with the female connector housing 9 under inclined condition relative to each other as shown in FIG. 3, since the front end surface of the male connector housing 11 is brought into contact with the inner ends **10*a* of the incline prevention projections 10A, 10B, 10C, respectively of the guide projections 6 of the female connector housing 9, the male connector housing 11 cannot be engaged with the female connector housing 9, so that it is possible to prevent the male connector 2 from being engaged with the female connector 1 under inclined engagement condition and thereby it is possible to prevent the male tab terminals 13 of the female connector 1 from being bent and deformed by the male connector housing 11 of the male connector 2**.

With respect to the inclined engagement, in the case of the conventional connector, the radius r (see FIG. 3) of the inclinable engagement of the male connector 2 is about ½ of L3 (see FIG. 1) which corresponds to the height of the engagement chamber of the female connector housing 9. In contrast with this, in the case of the connector according to the present invention, the radius r of the inclinable engagement of the male connector 2 can be reduced down about to ½ of L2 (=L3−L1) (see FIG. 1), where L1 is a height between the end surface **10*a* of the incline prevention projection 10A. 10B, 10C, respectively and the inner bottom surface of the female connector housing 9. In other words, since the radius r of the inclinable engagement can be reduced by L1/2 and thereby since a space corresponding to this distance of L1/2 can be secured between the rear ends of the male tab terminals 13 of the female connector 1 and the front end surface of the inclined male connector 2 as shown in FIG. 3, it is possible to prevent the interference between the male tab terminals 13 and the male connector housing 11. Further, after the incline prevention projections 10A (projections 10B, FIG. 1B, or projections 10C, FIG. 1C) of the female connector housing 9 have been engaged with the slide guide grooves 12A (FIG. 1A), 12B (FIG. 1B), or 12C (FIG. 1C) of the male connector housing 11, it is possible to engage both the connector housings 9 and 11** smoothly without providing a large play between both.

As described above, in the inclined engagement prevention structure of the connector according to the present invention, which is composed of the female connector 1 and the male connector 2, when one of the male and female connectors are engaged under an inclined condition, since the incline prevention projections 10A, 10B, 10C, respectively of the guide projections 6 of the female connector housing 9 are brought into contact with the outer front wall end surface of the male connector housing 11 in such a way as to reduce the internal engagement distance between both the connector housings 9 and 11 under the inclined condition, it is possible to prevent the interference between the male tab terminals 18 in the female connector housing 9 and the male connector housing 11, with the result that it is possible to prevent the malconnection of the male and female terminals due to deformation of the male tab terminals 13, without increasing the size of the female connector housing 9.

What is claimed is:

1. An inclined engagement prevention structure for a connector comprising:

a female connector housing formed with at least one guide projection extending inward therein and provided with a plurality of male terminals; and a male connector housing formed with at least one guide groove on an outer surface thereof so as to be engaged with the guide projection and provided with a plurality of female terminals, wherein:

the guide projection is formed with an incline prevention projection at an inward end thereof, and the guide groove is formed with a slide guide groove at an inner end thereof in such a way that the incline prevention projection can be engaged with and slidable along the slide guide groove.

2. The inclined engagement prevention structure for a connector of claim 1, wherein the incline prevention projection of the guide projection extends outward from the guide projection and the slide guide groove of the guide groove extends also outward from the guide groove.

3. The inclined engagement prevention structure for a connector of claim 1, wherein the incline prevention projection of the guide projection extends inward from the guide projection and the slide guide groove of the guide groove extends also inward from the guide groove.

4. The inclined engagement prevention structure for a connector of claim 1, wherein the incline prevention projection of the guide projection extends both inward and outward from the guide projection and the slide guide groove of the guide groove extends also both inward and outward from the guide groove.

5. The inclined engagement prevention structure for a connector of claim 1, wherein tile incline prevention projection of the guide projection is formed at least near an open end of the female connector housing.

* * * * *